US005310164A

United States Patent [19]

Rothfuss et al.

[11] Patent Number: 5,310,164

[45] Date of Patent: May 10, 1994

[54] TAPPING PIPE AND SYSTEM FOR A CONVERTER OR ELECTRIC ARC FURNACE

[75] Inventors: Hans Rothfuss, Taunusstein; Günther Haubold, Saarlouis; Dieter Bach, Moers; Werner Glasmacher; Dieter Stüsser, both of Duisburg, all of Fed. Rep. of Germany

[73] Assignee: Didier-Werke AG, Wiesbaden, Fed. Rep. of Germany

[21] Appl. No.: 32,262

[22] Filed: Mar. 17, 1993

[30] Foreign Application Priority Data

Mar. 17, 1992 [DE] Fed. Rep. of Germany ..... 4208520

[51] Int. Cl.[5] ..... B22D 41/50

[52] U.S. Cl. ..... 266/45; 266/236; 222/590; 222/594

[58] Field of Search ..... 266/45, 236; 222/590, 222/594, 597, 591

[56] References Cited

U.S. PATENT DOCUMENTS 4,427,184 1/1984 Steinwider et al. ..... 266/236
4,634,106 1/1987 LaBate, II ..... 222/597
4,756,452 7/1988 Tsukomoto et al. ..... 222/603
4,984,769 1/1991 Brückner et al. ..... 266/45

FOREIGN PATENT DOCUMENTS 0057946 5/1986 European Pat. Off. .

*Primary Examiner*—Scott Kastler
*Attorney, Agent, or Firm*—Wenderoth, Lind & Ponack

[57] ABSTRACT

A tapping pipe is provided for a melt vessel having a predetermined melt maximum bath level $X_m$. The tapping pipe defines a flow passage therethrough which has a discharge zone having flow cross-sections approximately the same as the cross-sections of the flow profile of a free flowing stream of the melt from a melt bath level $X_0$ between 30% and 70% of the maximum melt bath level $X_m$. The discharge zone can be provided by a brick defining the discharge zone, together with additional bricks defining a feed zone and a transition zone between the feed zone and the discharge zone. In making a number of replacements of the tapping pipe in a converter, the length of the brick defining the transition zone can be gradually reduced so as to compensate for the wear of the converter lining.

19 Claims, 4 Drawing Sheets

Xm
X0
H2
H3
H1
I2
I3
I1
3
7

S0

Xm
X0
Xu
H2
H3
H1
I2
I3
I1
3

OPTIMIZED TAPPING
CYLINDRICAL TAPPING
STEPPED TAPPING
t (min) TAPPING PERIOD
MAXIMUM TAPPING PERIOD To
ALLOWED TAPPING PERIOD
MINIMUM TAPPING PERIOD Tu
0
1
2
3
4
5
6
7
0
10
20
30
40
50
60
70
80 (n)
TAPPINGS OPTIMIZED TAPPING
CYLINDRICAL TAPPING
STEPPED TAPPING
"T" ALLOWED TAPPING PERIOD
REPAIRS
TAPPINGS (n)
100
200
300
400
500
600
700

TAPPING PIPE AND SYSTEM FOR A CONVERTER OR ELECTRIC ARC FURNACE

BACKGROUND OF THE INVENTION

1 Field of the Invention

The present invention relates to a tapping pipe for a melt vessel such as a converter or an electric arc furnace. A tapping pipe has flow cross-sections, or cross-sectional flow areas, that, at the level of a discharge zone of the tapping pipe, are less than at levels closer to the inside of the converter or electric arc furnace.

2 State of the Prior Art

The type of tapping pipe mentioned above is described in EP 0 057 946 B1. In this tapping pipe, the flow cross-sections of the tapping pipe taper in steps from a feed zone closer to the inside of the converter toward the discharge zone of the tapping pipe. In this manner, the tapping channel of the tapping pipe is adjusted to the flow conditions of the tapping stream.

When a tapping pipe wears, the flow resistance of the tapping pipe decreases. Consequently, the tapping period, and thus the period of time in which the converter empties, starting from its maximum bath level down to its minimum bath level, changes accordingly. This is a disadvantage, because the tapping time affects the temperature of the melt in the next, downstream, vessel. Thus a prolonged tapping period will result in lower melting temperatures in the following vessel than with shorter tapping periods. To avoid the resulting metallurgical irregularities, the melt then has to be reheated. This requires a considerable amount of energy.

SUMMARY OF THE INVENTION

Accordingly, the object of the present invention is to provide a tapping pipe of the type described above that will exhibit as identical a tapping period as possible for tappings to be carried out with the pipe.

According to the present invention, the above object is fulfilled by the provision of a tapping pipe in a melt vessel that has a predetermined maximum melt bath level $X_m$, the tapping pipe comprising a pipe defining a flow passage therethrough. The pipe has a discharge zone extending along the flow passage for discharge of the melt from the tapping pipe. The flow passage, at the discharge zone, has flow cross-sections approximately the same as the cross-sections of the flow profile of a free flowing stream of the melt from a melt bath level $X_0$ between 30% and 70% of the maximum melt bath level $X_m$. Preferably the melt bath level $X_0$ is between 40% and 50% of the maximum melt bath level $X_m$.

According to a further feature of the present invention, the tapping pipe is provided with a feed zone having flow cross-sections that are approximately the same as the cross-sections of the flow profile of a free flowing stream of the melt from a minimum melt bath level $X_u$. The tapping pipe according to the present invention further preferably comprises a transition zone providing a smooth connecting transition between the feed zone and the discharge zone. Additionally, first, second, and third bricks are provided defining the discharge, feed and transition zones.

The flow cross-section of the profile of the free flowing melt stream is determined by the formula $A(x)=m/r(2gx)^{\frac{1}{2}}$, wherein A(x) is the flow cross-section, m is the mass flow of the melt per unit time, r is the density of the melt, g is the force of gravity and x is the level of the flow cross-section.

The melt vessel is preferably provided with a plurality of the first, second and third bricks. All of the first bricks may be identical to each other, and all of the second bricks may be identical to each other. However, the third bricks should progressively decrease in length. By this arrangement, the melt vessel can be repeatedly used for tapping, and the tapping pipe can then be repeatedly replaced in the melt vessel as the bricks of the tapping pipe wear out. Progressively shorter third bricks, defining the transition zone, are used to compensate for wear of the lining of the melt vessel.

DETAILED DESCRIPTION OF THE PREFERRED EMBODIMENTS

Figure 1:
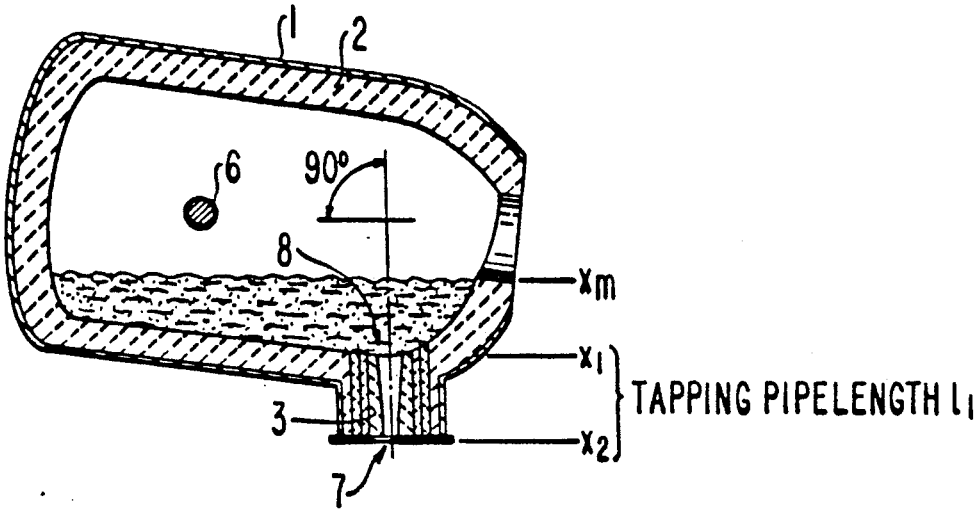
FIG. 1 is a cross-sectional view of a converter in a discharge position having a tapping pipe in a vertical position.

First referring to FIG. 1, a converter 1 has a lining 2 which is situated a tapping pipe 3 protruding beyond the converter. Between the tapping pipe 3 and the lining 2 are provided intermediate layers 4 and 5. Note also FIG. 2.

Figure 2:
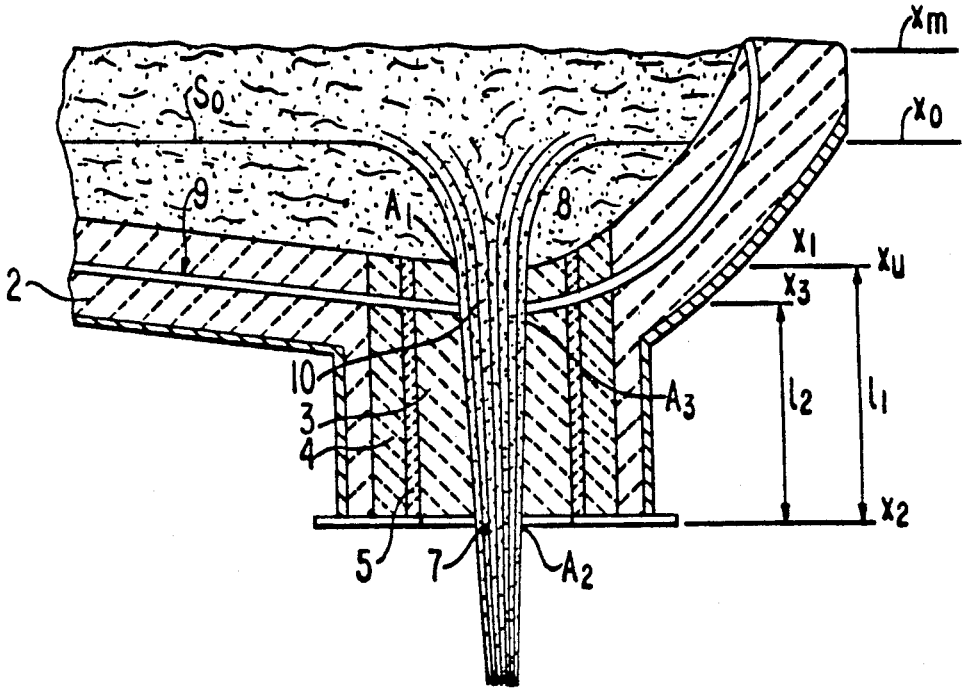
FIG. 2 is a cross-sectional view on an enlarged scale of a portion of FIG. 1.

If the converter 1 is pivoted about a pivot axis 6 so that the tapping pipe 3 is vertical, then the result is that a maximum bath level $X_m$ is achieved in the converter 1, as illustrated in both FIGS. 1 and 2. A discharge opening 7 of the tapping pipe 3 is provided at a designated level $X_2$. For a new or unworn lining 2 of the converter 1, a feed opening 8 of the tapping pipe 3 is at a feed level $X_1$. Between the feed level $X_1$ and the discharge level $X_2$ is a length $L_1$. This is illustrated in FIG. 2.

If the lining 2 is worn as a result of use of the converter or melt vessel 1 for tapping, as is illustrated in FIG. 2 by a wear line 9, then the tapping pipe 3 is also worn, so that a current feed opening 10 would be at a feed level $X_3$. Then, the tapping pipe 3 between the feed level $X_3$ and the discharge level $X_2$ would only have a length $L_2$, less than the length $L_1$.

During tapping, the melt bath level will drop. At an average bath level, the bath level is at $X_0$. This amount is 30% to 70%, and preferably 40% to 50%, of the amount the maximum bath level $X_m$ is above the minimum bath level $X_u$.

Further, the flow cross-sections, or flow cross-sectional areas, of the tapping pipe 3 at different levels thereof, at least in the discharge zone of the tapping pipe 3, are approximately equal to the cross-sections of the flow profile of the melt if the melt were a free flowing stream, and not guided by the tapping pipe, for the melt bath level $X_0$. Thus, the flow profile of the tapping pipe, at least in the discharge zone, is adjusted to the free flowing stream flow profile at an average bath level, between 30% and 70%, and preferably 40% to 50%, of the maximum bath level. This flow profile can be calculated from the known formula:

$$A(x)=m/r(2gx)^{\frac{1}{2}}$$

wherein:

a(x)=the flow cross-section at a level x, m=mass flow of the melt per unit time, r=the density of the melt, g=the force of gravity, and x=the level for a respective flow cross-section.

In accordance with the resulting computed flow profile of the vertical hot metal melt flow at an average bath level, the flow cross-sections are determined and adjusted to the flow profile of the melt along different levels of the tapping pipe. This is done at least in the discharge zone of the tapping pipe 3. In other words, a flow profile $S_0$, as seen in FIG. 2, for example, produced at the average bath level $X_0$, without the tapping pipe 3, can be calculated from the above formula for different levels between the feed level $X_1$ and the discharge level $X_2$. According to the calculation, the flow cross-sections $A_1$, $A_3$, and $A_2$ at levels $X_1$, $X_3$, and $X_2$, respectively, and also at intermediate levels, can be dimensioned to be as identical as possible to the respective cross-sections of the flow profile $S_0$ of the melt at that point. Due to the fact that the tapping pipe is then adapted to the flow profile $S_0$, the outer contours of the flow profile always rest against the tapping channel. In this manner, the tapping channel is always filled with the metal melt.

Figure 6:
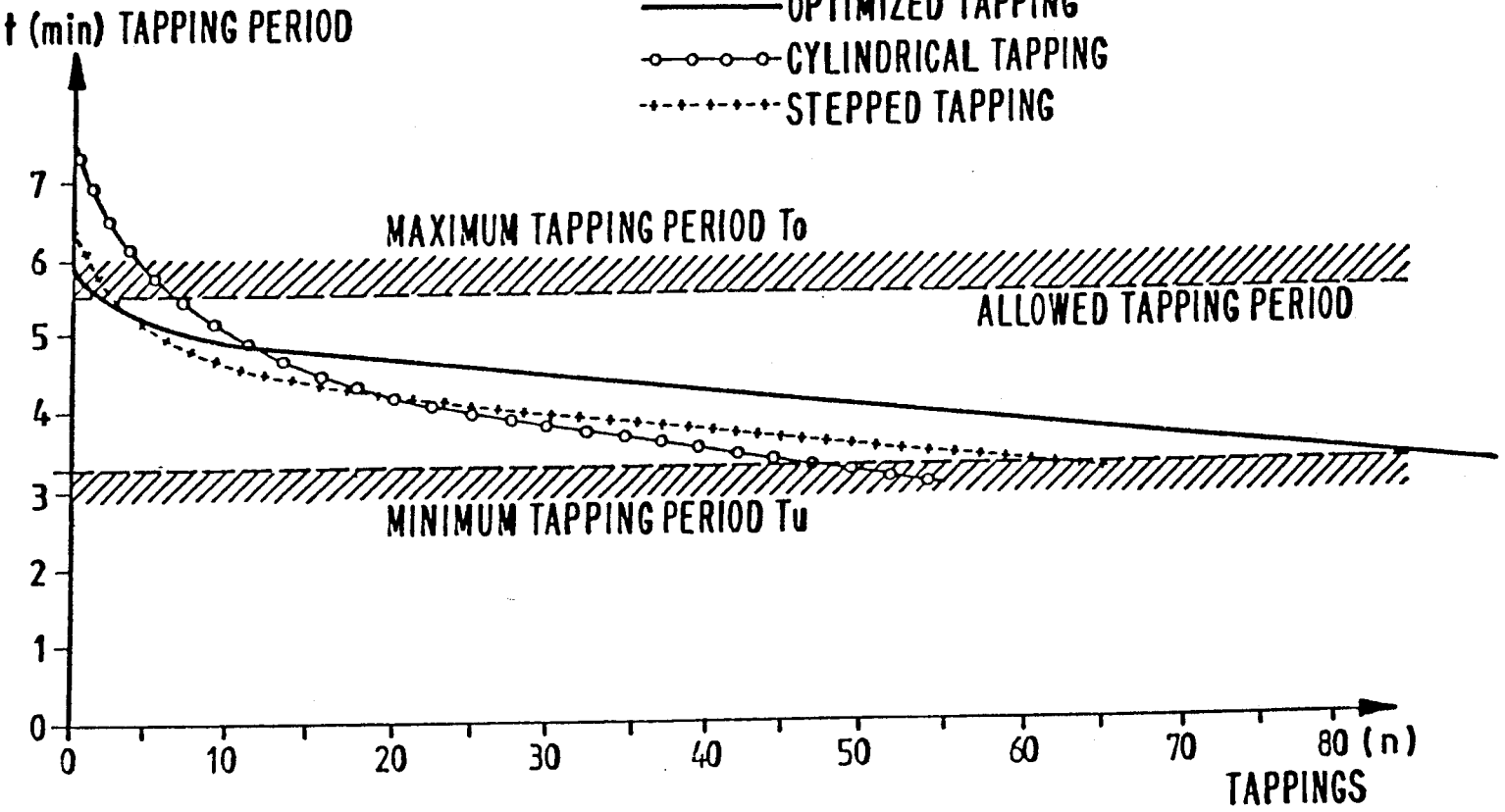
FIG. 6 is a graph illustrating tapping periods of the present invention as compared with other types of tapping pipe arrangements.

Further, by adjusting the flow cross-sections to the hot melt flow from the average bath level $X_0$, during tapping the tapping periods are in resulting narrow ranges, becoming as identical as possible. FIG. 6 illustrates this feature.

FIG. 6 shows a maximum tapping period To, at, for example, 5.5 minutes, and a minimum tapping period Tu at about 3.5 minutes. These designated maximum and minimum tapping periods are preferred, because tapping periods between these two points do not pose a problem from a metallurgical point of view.

The solid line in FIG. 6 is a curve of tapping periods for 80 tappings using a tapping pipe 3 according to the present invention. Thus, with the tapping pipe 3 of the present invention, 80 tappings are possible without going above or below the allowable tapping period limits To and Tu.

With further reference to FIG. 6, for purposes of comparison are presented curves for tapping with a cylindrical tapping pipe and a stepped or purely conical tapping pipe. The curve for the cylindrical tapping pipe is denoted as "-0-0-0". As can be seen, the tapping period for this curve does not fall into the range between To and Tu until about the tenth tapping. Prior to that, the tapping periods are longer. Further, the tapping period falls below the minimum of tapping period Tu at already about the fiftieth tapping using the cylindrical tapping pipe. The curve "-+-+-+" represents the stepped or the purely conical tapping pipe. The tapping period at a number of initial tappings is also in this case above the maximum allowable tapping period To. Further, the tapping periods fall below the minimum allowable tapping period Tu already at about 65 tappings. Thus can be clearly seen that the tapping pipe according to the present invention provides a greater number of useful tappings than have been known.

Figure 7:
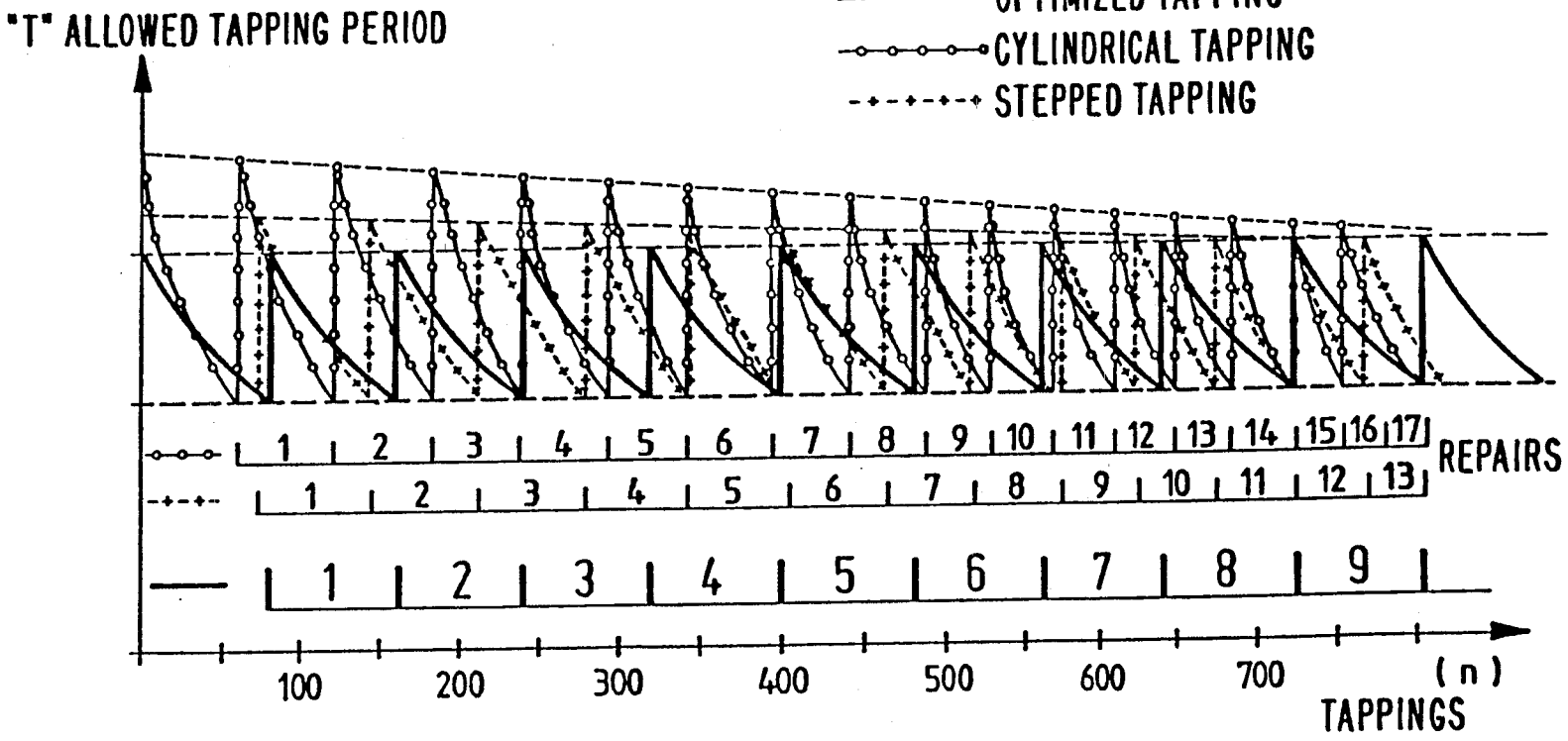
FIG. 7 is a graph illustrating the intervals between replacements of the tapping pipe according to the present invention over the number of possible tappings with the converter until replacement or repair of the converter, as compared with other arrangements.

FIG. 7 illustrates another advantage according to the present invention. This advantage is based on the fact that, for the tapping pipe of the invention, the allowable tapping period is, essentially, identical over a great number of tappings. FIG. 7 is based on the fact that, after about 800 tappings, the converter 1, or its lining 2, has to be renewed. The three different types of lines used in FIG. 7 correspond to those employed in FIG. 6.

In FIG. 7, it is evident that the tapping pipe 3 according to the present invention has to be replaced only 9 times over 800 tappings. In contrast, the conventional tapping pipe having a purely cylindrical flow cross-section has to be replaced 17 times. Further, the tapping pipe having the stepped cross-section has to be replaced 13 times during the 800 tappings.

It is further advantageous that, for the tapping pipe 3 according to the present invention, the intervals between the replacements of the tapping pipe 3 are identical, thus corresponding to identical numbers of tappings. In the case of FIG. 7, this is 80 tappings. Thus, personnel can always renew the tapping pipe 3 after the same number of tappings until the converter 1 or the lining 2 is renewed. In contrast, for the tapping pipes 3 according to the state of the art, the time span between replacements of the tapping pipe becomes continuously shorter. Thus in the case of a converter that is exhibiting more wear, the personnel have to replace the tapping pipe of the state of the art sooner than when the converter was exhibiting less wear.

Figures 3, 4, 5:
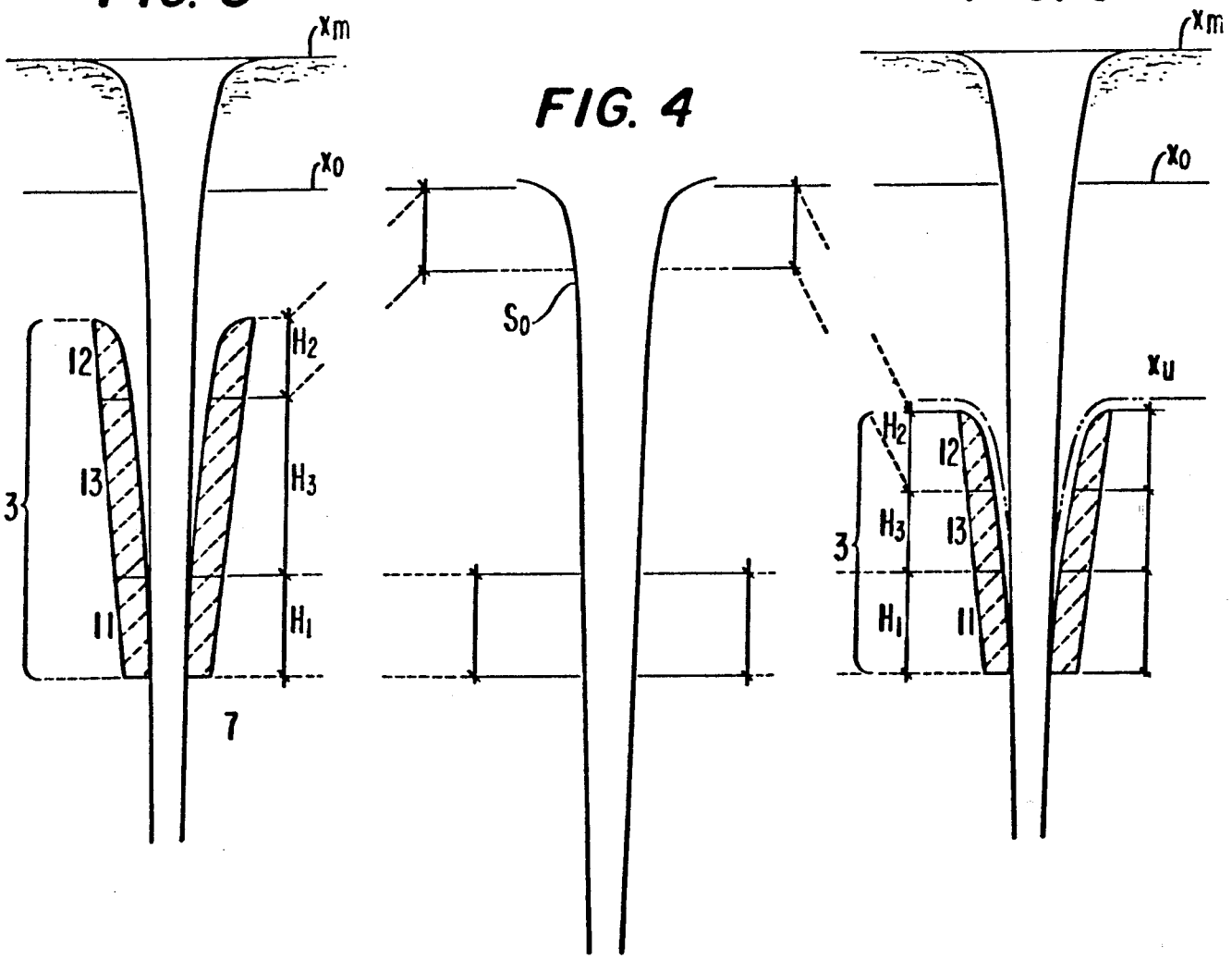
FIG. 3 is a schematic view of a three part tapping pipe according to the present invention for a converter that has not been worn, with a hot metal flow profile at a maximum bath level.
FIG. 4 illustrates the hot metal flow profile at an average bath level of 30% to 70% of the maximum bath level.
FIG. 5 is a schematic view similar to FIG. 3 of a three piece tapping pipe for a worn converter, wherein the flow profile at the maximum bath level is indicated with a solid line and the flow profile at a minimum bath level is indicated with a dashed and double-dotted line.

A specific embodiment according to the present invention is discussed with respect to FIGS. 3–5. In this embodiment, the tapping pipe 3 is composed of three bricks 11, 12 and 13.

Brick 11 forms the discharge zone of the tapping pipe 3. The flow cross-sections of the brick 11, at its level H1, are dimensioned so as to correspond to the flow profile $S_0$ of the melt at this level, for an average bath level $X_0$ for a free flowing stream of the melt. See for example FIG. 4.

The brick 12 forming a feed zone of the tapping pipe 3 is dimensioned so that at different levels of its flow cross-section, the flow cross-sections above its level H2 correspond to the flow profile resulting at a minimum or bottom bath level $X_u$. See for example FIG. 5, referring to the dashed and double-dotted line. This feature is especially preferred when the lining 2 of the converter 1 has been consumed to the extent that the wear of the converter is approaching the wear line 9.

The brick 13 is designed as a transition brick. A number of these transition bricks 13 should be provided with Varying heights H3. In each case, the transition brick 13 is designed so that it forms, on the interior or flow channel thereof, as smooth a transition as possible between the bricks 11 and 12.

FIGS. 3 and 5 illustrate bricks 11 of identical dimensions for the discharge zone, and bricks 12 of identical dimensions for the feed zone. Only the bricks 13 of the transition zone are designed differently. The different shape of the bricks 13 is with respect to their height H3, which is adapted to the wear of the lining 2 of the converter 1. The wear advances in the direction of the wear line 9. Noting FIG. 7, for a converter service life of 800 tappings, nine replacements of the tapping pipe 3 are anticipated, and transition bricks having nine or ten different lengths H3 would be planned accordingly so as to join as steplessly as possible the bricks 11 and 12, providing a smooth transition between the discharge zone and the feed zone. The bricks 11 and 12 are maintained the same.

The above method simplifies the repair or replacement work of the tapping pipe 3, due to the simple brick arrangement. The design is further advantageous, because comparatively few and simple to manufacture brick formats are sufficient to be manufactured in order to provide the necessary tapping pipes guaranteeing approximately identical tapping periods for the converter service life.

In the above, note that the bath level of the converter changes constantly, from $X_m$ to $X_0$ and finally $X_u$. Therefore, the calculation of the tapping channel is laid out according to the invention so that at the maximum bath level $X_m$ the flow profile $S_o$ rests at least at H1, and possibly also in H3. The tapping stream is thus guided and the tapping channel is always filled in this region. Note FIG. 3.

At the minimum bath level $X_u$, the smallest tapping stream rests freely against H2 and in part against H3, and is then automatically led away by H1. Note FIG. 5. Thus, the tapping channel is constantly filled, and the flow resistance, generated in tapping channels that are not optimally designed, is minimized.

In conventional tappings the tapping channel may not be completely filled. Therefore, ambient air will tend to collect in the tapping channel. This results in high wear. The present invention, however, helps to avoid this problem, as explained above.

The tapping pipe, system and method according to the present invention has been described above in detail with respect to preferred embodiments thereof. However, those of ordinary skill in the art will recognize that changes and modifications can be made to the present invention without departing from the scope thereof as reflected in the flowing claims.

We claim:

1. A tapping pipe for use in repeatedly tapping a melt bath of molten metal from a melt vessel in a tapping position of the melt vessel, the melt vessel having, in the tapping position thereof, a maximum melt bath level $X_m$, and said tapping pipe comprising:

a pipe defining a flow passage therethrough and comprising means for maintaining the tapping period of a melt bath being tapped from the melt vessel through said flow passage substantially constant over a plurality of tappings, said means including a discharge zone extending along said flow passage that has flow cross-sections approximately the same as the cross-sections of the flow profile of a free flowing stream of the melt from a melt bath level $X_o$ between 30% and 70% of the maximum melt bath level $X_m$.

2. The tapping pipe of claim 1, wherein the melt bath level $X_o$ is between 40% and 50% of the maximum melt bath level $X_m$.

3. The tapping pipe of claim 1, wherein the flow cross-section of the profile of the free flowing melt stream is determined by $$A(x)=m/r(2gx)^{\frac{1}{2}}$$

wherein A(x) is the flow cross-section at a level x, m is the mass flow of the melt per unit time, r is the density of the melt, g is the force of gravity and x is the level of the flow cross-section.

4. The tapping pipe of claim 1, wherein said pipe comprises a brick defining said discharge zone.

5. The tapping pipe of claim 3, wherein said pipe further has a feed zone having flow cross-sections approximately the same as the cross-sections of the flow profile of a free flowing stream of the melt from a minimum melt bath level $X_u$.

6. The tapping pipe of claim 1, wherein said pipe comprises a first brick defining said discharge zone, a second brick defining said feed zone and a third brick between said first brick and said second brick defining a transition zone between said feed zone and said discharge zone.

7. The tapping pipe of claim 1, wherein said pipe further has a feed zone having flow cross-sections approximately the same as the cross-sections of the flow profile of a free flowing stream of the melt from minimum melt bath level $X_u$.

8. The tapping pipe of claim 7, wherein said pipe further has a transition zone providing a smooth connecting transition between said feed zone and said discharge zone.

9. A melt vessel tapping system, comprising: a melt vessel containing a melt bath of molten metal, said melt vessel having a tapping position at which there is a maximum melt bath level $X_m$ and a minimum melt bath level $X_u$; and a tapping pipe in said melt vessel for tapping melt from said melt vessel in said tapping position, said tapping pipe having a flow passage therethrough and a discharge zone extending along said flow passage for discharging the melt from said tapping pipe;

wherein said discharge zone of said tapping pipe has flow cross-sections approximately the same as the cross-sections of the flow profile of a free flowing stream of the melt from a melt bath level $X_o$ between 30% and 70% of the maximum melt bath level $X_m$.

10. The melt vessel tapping system of claim 9, wherein the melt bath level $X_o$ is between 40% and 50% of the maximum melt bath level $X_m$.

11. The melt vessel tapping system of claim 9, wherein a flow cross-section of the profile of the free flowing melt stream is determined by $$A(x)=m/r(2gx)^{\frac{1}{2}}$$

wherein A(x) is the flow cross-section at a level x, m is the mass flow of the melt per unit time, r is the density of the melt, g is the force of gravity and x is the level of the flow cross-section.

12. The melt vessel tapping system of claim 9, wherein said tapping pipe comprises a brick defining said discharge zone.

13. The melt vessel tapping system of claim 12, wherein said tapping pipe further has a feed zone having flow cross-sections approximately the same as the cross-sections of the flow profile of a free flowing stream of the melt from the minimum melt bath level $X_u$.

14. The melt vessel tapping system of claim 9, wherein said tapping pipe comprises a first brick defining said discharge zone, a second brick defining a feed zone and a third brick between said first brick and said second brick defining a transition zone between said feed zone and said discharge zone.

15. The melt vessel tapping system of claim 14, and further comprising:

a plurality of additional first bricks substantially identical to the said first brick for replacing the said first brick;

a plurality of additional second bricks substantially identical to the said second brick for replacing the said second brick; and a plurality of additional third bricks, said additional third bricks varying in length for replacing the above said third brick;

whereby said tapping pipe can be repeatedly replaced in said melt vessel as said bricks of said tapping pipe wear out, said third bricks, varying in length, being able to compensate for wear of said melt vessel.

16. The melt vessel tapping system of claim 9, wherein said tapping pipe further has a feed zone having flow cross-sections approximately the same as the cross-sections of the flow profile of a free flowing stream of the melt from the minimum melt bath level $X_u$.

17. The melt vessel tapping system of claim 16, wherein said tapping pipe further has a transition zone providing a smooth, connecting transition between said feed zone and said discharge zone.

18. A method of tapping melt from a melt vessel, comprising the steps of:

a) repeatedly tapping melt from a melt vessel that has a maximum melt bath level $X_m$ and a minimum melt bath level $X_u$ through a tapping pipe in the melt vessel until the tapping pipe becomes worn, the tapping pipe being composed of a first brick defining a discharge zone, a second brick defining a feed zone and a third brick defining a transition zone between the feed zone and the discharge zone, and the first brick having the discharge zone thereof having flow cross-sections approximately the same as the cross-sections of the flow-profile of a free flowing stream of the melt from a melt bath level $X_o$ between 30% and 70% of the maximum melt bath level $X_m$; and b) replacing the tapping pipe in the melt vessel by replacing the first brick with a new first brick substantially identical to the first brick, replacing the second brick with a new second brick substantially identical to the second brick and replacing the third brick with a new third brick having a shorter length than the third brick being replaced so as to compensate for wear of the lining of the melt vessel.

19. The method of claim 18, and further comprising repeating steps a) and b) until the lining of the melt vessel is worn out.

* * * * *